US008872073B2

(12) United States Patent
Watanabe

(10) Patent No.: US 8,872,073 B2
(45) Date of Patent: Oct. 28, 2014

(54) IMAGE FORMING APPARATUS

(75) Inventor: Tetsuya Watanabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 539 days.

(21) Appl. No.: 13/233,547

(22) Filed: Sep. 15, 2011

(65) Prior Publication Data

US 2012/0074119 A1 Mar. 29, 2012

(30) Foreign Application Priority Data

Sep. 27, 2010 (JP) ..... 2010-215768

(51) Int. Cl.
*H05B 1/02* (2006.01)
*G03G 15/20* (2006.01)

(52) U.S. Cl.
CPC ..... *G03G 15/2039* (2013.01)
USPC ..... 219/483; 219/216; 219/492; 399/69; 323/235

(58) Field of Classification Search
CPC ..... H05B 1/02; H05B 1/0202; H05B 1/0241; H05B 3/026; H02M 3/1563; H05J 3/00; G03G 15/80
USPC ..... 219/505, 492, 497, 216; 399/69; 323/235, 319
See application file for complete search history.

(56) References Cited

U.S. PATENT DOCUMENTS

| | | | | |
|---|---|---|---|---|
| 4,282,422 | A * | 8/1981 | Payne et al. | 219/486 |
| 5,464,964 | A * | 11/1995 | Okuda et al. | 219/497 |
| 6,177,657 | B1 * | 1/2001 | Takata | 219/497 |
| 2009/0074442 | A1 * | 3/2009 | Sano et al. | 399/69 |
| 2011/0064444 | A1 * | 3/2011 | Adachi et al. | 399/69 |

FOREIGN PATENT DOCUMENTS

| | | | |
|---|---|---|---|
| JP | 10-213996 | A | 8/1998 |
| JP | 2004-303469 | A | 10/2004 |
| JP | 2006-119426 | A | 5/2006 |

* cited by examiner

*Primary Examiner* — Mark Paschall
(74) *Attorney, Agent, or Firm* — Kubotera & Associates, LLC

(57) ABSTRACT

An image forming apparatus includes a heat source of a fixing device to heat when an alternate current signal is supplied thereto; a conduction control circuit for controlling an alternate current power source with a conduction control signal, and for supplying the alternate current signal to the heat source; and a control unit for outputting the conduction control signal in a specific pattern. The conduction control circuit includes a conduction control element for switching between conduction and non-conduction at a zero cross timing of the alternate current power source according to the conduction control signal, and for supplying the alternate current signal.

19 Claims, 8 Drawing Sheets

IMAGE FORMING APPARATUS

BACKGROUND OF THE INVENTION AND RELATED ART STATEMENT

The present invention relates to an image forming apparatus such as a printer, a facsimile, a copier, and a multifunction product. More specifically, the present invention relates to an image forming apparatus having a fixing device with a heater.

In a conventional image forming apparatus, after a developer image as a toner image is formed on a photosensitive drum, a fixing roller and the like of a fixing device fixes the developer image at a specific temperature. The fixing roller is heated to a specific temperature with a heater that heats with an electrical current flowing from an alternate current power source. The alternate current power source for the heater to heat tends to cause a problem such as a high frequency current or a shortened life of a heating device.

To this end, there has been a technology, in which a zero cross circuit is provided for detecting a zero cross point of an alternate current power source voltage, and a phototriac coupler is operated to perform on-off control per every half cycle based on the zero cross point. Accordingly, it is possible to prevent the alternate electrical current supplied to the heater from shifting to a positive side or a negative side. As a result, it is possible to suppress the high frequency current and extend a life of the heating device.

Patent Reference has disclosed a conventional image forming apparatus. In the conventional image forming apparatus, a central process unit (referred to as a CPU) is provided for transmitting a heating off signal, so that an alternate electrical current supplied to the heating device is controlled and shut off. When the CPU transmits the heating off signal, the CPU generates a control signal to regularly turn on and off an alternate current voltage per half cycle for a specific number of times. A switch element is provided for applying the alternate current voltage to the heating device according to the control signal.

Patent Reference: Japanese Patent Publication No. 10-213996

In the conventional image forming apparatus, a zero cross circuit is provided for detecting the zero cross point. According to the zero cross point thus detected, a heater conduction timing is synchronized with the zero cross point, so that the heater is conducted per half cycle. Accordingly, it is necessary to provide the heater conduction circuit with a complex configuration.

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to an aspect of the present invention, an image forming apparatus includes a heat source of a fixing device to heat when an alternate current signal is supplied thereto; a conduction control circuit for controlling an alternate current power source with a conduction control signal, and for supplying the alternate current signal to the heat source; and a control unit for outputting the conduction control signal in a specific pattern. The conduction control circuit includes a conduction control element for switching between conduction and non-conduction at a zero cross timing of the alternate current power source according to the conduction control signal, and for supplying the alternate current signal.

In the aspect of the present invention, the conduction control circuit for supplying the alternate current signal includes the conduction control element operating at a zero cross point. Further, the conduction control circuit is controlled in the specific pattern in a simple method. Accordingly, it is possible to suppress a high frequency current and extend a life of the heat source of the fixing device or a protection element thereof.

Further, in the aspect of the present invention, the control unit is provided for outputting the conduction control signal in the specific pattern. In addition, the conduction control element is provided for conducting the heat source over a half cycle at the zero cross timing of the alternate current power source. Accordingly, it is possible to reduce an effective value of an electrical current supplied to the heat source.

DETAILED DESCRIPTION OF PREFERRED EMBODIMENTS

Hereunder, embodiments of the present invention will be explained with reference to the accompanying drawings. It is noted that the accompanying drawings are presented for explanation purpose only, and the present invention is not limited thereto.

First Embodiment

Figure 2:
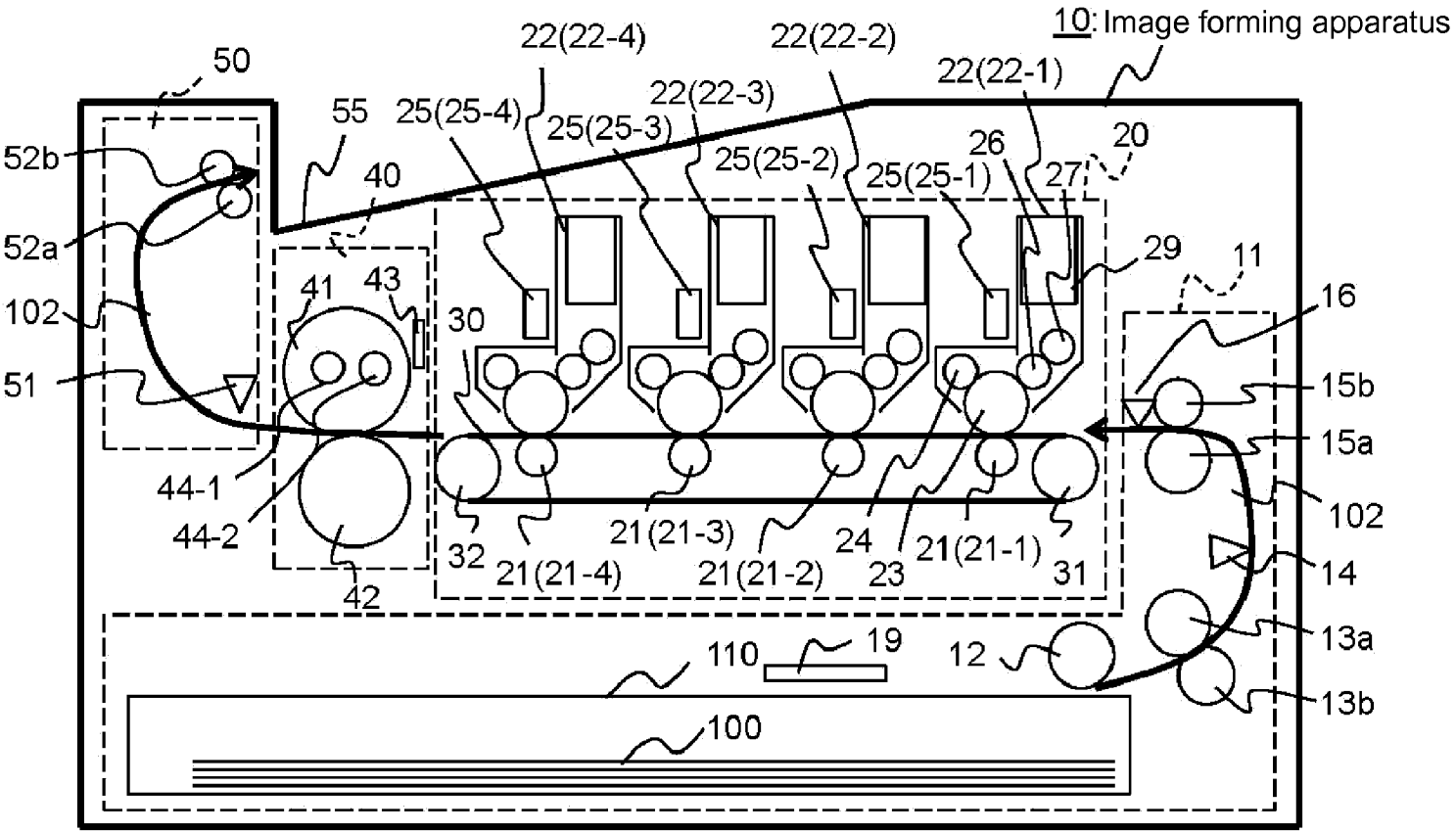
FIG. 2 is a schematic sectional view showing a configuration of the image forming apparatus according to the first embodiment of the present invention.

A first embodiment of the present invention will be explained. FIG. 2 is a schematic sectional view showing a configuration of an image forming apparatus 10 according to the first embodiment of the present invention.

As shown in FIG. 2, the image forming apparatus 10 is a printer of a tandem type, and includes a sheet supply portion 11 for supplying a recording medium 100 (for example, a recording sheet); an image forming portion 20 for forming a toner image 101 (refer to FIG. 3) on the recording medium 100; a fixing device 40 for fixing the toner image 101 to the recording medium 100; a sheet discharge portion 50 for discharging the recording medium 100; and a stacker portion 55 for storing the recording medium 100 thus discharged.

In the embodiment, the image forming apparatus 10 further includes a motor (not shown) for rotating various rollers; a clutch for switching a transmission drive to a roller of a transportation path 102; a high voltage power source 66 (described later, refer to FIG. 4); and a low voltage power source 60 (described later, refer to FIG. 4). The high voltage power source 66 (described later, refer to FIG. 4) is provided for supplying a high voltage of 200 V to 500 V to a charging roller 24, a transfer roller 21 and the like of an image forming unit 22. The low voltage power source 60 (described later, refer to FIG. 4) is provided for supplying a direct current voltage of 5 V or 24 V to a circuit or a motor.

In the embodiment, the sheet supply portion 11 includes a sheet storage cassette 110 disposed at a lower portion of the image forming apparatus 10 for storing the recording medium 100; a hopping roller 12 for separating and picking up the recording medium 100 from the sheet storage cassette 110 one by one; a sheet supply roller 13*a*; a retard roller 13*b*; a sheet supply sensor 14; a pair of register rollers 15*a* and 15*b*; a writing start position sensor 16; and a sheet color measurement unit 19 for measuring a color of the recording medium 100.

In the embodiment, the sheet storage cassette 110 is provided for storing a plurality of recording sheets 100, and is detachably disposed at the lower portion of the image forming apparatus 10. The recording sheet 100 has a specific size for recording an image in monochrome or color, and may include a high quality sheet, a recycle sheet, a gloss sheet, a matt sheet, an OHP (Over Head Projector) film, and the like. The sheet color measurement unit 19 is provided for measuring a color of the recording medium 100 stored in the sheet storage cassette 110.

In the embodiment, the hopping roller 12 is arranged to press against the recording medium 100 to rotate. The sheet supply roller 13*a* and the retard roller 13*b* are arranged on an upstream side of the transportation path 102 to face with each other with the recording medium 100 in between. The sheet supply sensor 14 is disposed on a downstream side of the sheet supply roller 13*a* and the retard roller 13*b*.

In the embodiment, the register rollers 15*a* and 15*b* are arranged on the downstream side of the sheet supply sensor 14 in the transportation path 102 to face with each other with the recording medium 100 in between. The writing start position sensor 16 is disposed on the downstream side of the register rollers 15*a* and 15*b*. A register motor (not shown) is provided for driving the register roller 15*a*.

In the embodiment, the image forming portion 20 includes the image forming units 22 (22-1 to 22-4) in the order of black (K), yellow (Y), magenta (M), and cyan (C) from the right side in FIG. 2. Further, the image forming portion 20 includes the transfer rollers 21 (21-1 to 21-4) disposed below the image forming units 22; rollers 31 and 32; and a transportation belt 30 extended between the rollers 31 and 32.

In the embodiment, each of the image forming units 22 (22-1 to 22-4) corresponding to the four colors of black (K), yellow (Y), magenta (M), and cyan (C) includes a photosensitive drum 23 for supporting a static latent image according to image information; the charging roller 24 for charging the photosensitive drum 23; an LED (Light Emitting Diode) head 25 for irradiating light corresponding to the image information on a surface of the photosensitive drum 23; a developing roller 26 for developing the static latent image on the surface of the photosensitive drum 23 with toner; a toner supply roller 27 for supplying toner to the developing roller 26; a toner cartridge 29 configured to be separable; a toner regulating member (not shown); and a cleaning unit (not shown) for scraping off toner remaining on the photosensitive drum 23.

In the embodiment, the transportation belt 30 is provided for transporting the recording medium 100, and a transfer member for transferring the toner image 101 formed on the photosensitive drum 23 to the recording medium 100. The photosensitive drum 23 is arranged to abut against the transfer roller 21 with the transportation belt 30 in between.

In the embodiment, the photosensitive drum 23 includes a conductive base layer formed of aluminum and the like and a photosensitive layer disposed on the conductive base layer. The photosensitive layer is formed of an optical conductive layer and an electron charge transportation layer. The photosensitive drum 23 is formed in a circular cylindrical shape, and is supported to be rotatable. The photosensitive drum 23 is arranged to abut against the charging roller 24, the transfer roller 21, and the developing roller 26. Further, the photosensitive drum 23 is arranged to contact with a distal end portion of the cleaning unit. When the photosensitive drum 23 accumulates electron charges on the surface thereof, the photosensitive drum 23 functions as an image supporting member for supporting the toner image 101.

A configuration of the image forming unit 22 will be explained next in a rotational order of the photosensitive drum 23. The charging roller 24 includes a metal shaft having conductivity and coated with a semi-conductive rubber such as silicone rubber. The charging roller 24 is formed in a circular cylindrical shape, and is arranged to abut against the photosensitive drum 23 and rotatable. A high voltage power source 66 (described later, refer to FIG. 4) is provided for charging the charging roller 24. When the charging roller 24 abuts against the photosensitive drum 23 and rotates, the charging roller 24 applies a specific voltage to the photosensitive drum 23, so that the photosensitive drum 23 accumulates electron charges uniformly on the surface thereof.

In the embodiment, the LED head 25 includes an LED array chip, a lens array, and an LED drive element. The LED head 25 is disposed above the photosensitive drum 23. The LED head 25 is provided for irradiating light corresponding to the image information on the surface of the photosensitive drum 23, so that the static latent image is formed on the surface of the photosensitive drum 23.

In the embodiment, the toner supply roller 27 includes a metal shaft having conductivity and coated with a rubber. The toner supply roller 27 is formed in a circular cylindrical shape, and is arranged to abut against the developing roller 26. The high voltage power source 66 (described later, refer to FIG. 4) is provided for charging the toner supply roller 27. When the toner supply roller 27 abuts against the developing roller 26, the toner supply roller 27 supplies toner to the developing roller 26.

In the embodiment, the developing roller 26 includes a metal shaft having conductivity and coated with a semi-conductive urethane rubber and the like. The developing roller 26 is formed in a circular cylindrical shape, and is arranged to abut against the toner supply roller 27 and the photosensitive drum 23. Further, the developing roller 26 is arranged to contact with the distal end portion of the cleaning unit. The high voltage power source 66 (described later, refer to FIG. 4) is provided for charging the developing roller 26. When the developing roller 26 abuts against the toner supply roller 27, the toner supply roller 27 supplies toner to the developing roller 26.

In the embodiment, the toner regulating member (not shown) is formed of stainless steel and the like, and is formed in a plate shape. The toner regulating member is arranged such that a distal end portion thereof contacts with a surface of the developing roller 26. The toner regulating member is provided for scraping off toner on the surface of the developing roller 26 in an amount exceeding a specific level, so that the toner regulating member regulates a thickness of toner on the surface of the developing roller 26 at a constant level.

In the embodiment, the cleaning unit (not shown) is formed of a runner material and the like, and is formed in a plate shape. The cleaning unit is arranged such that the distal end portion thereof contacts with the surface of the photosensitive drum 23. After the toner image 101 formed on the surface of the photosensitive drum 23 is transferred to the recording medium 100, the cleaning unit scrapes off toner remaining on the photosensitive drum 23 for cleaning.

In the embodiment, the fixing device 40 includes a fixing roller 41, a pressing roller 42, a temperature detection sensor 43 as a temperature measuring portion, and heaters 44-1 and 44-2 as a plurality of heat sources. The heaters 44-1 and 44-2 are formed of, for example, halogen lamps, and are disposed inside the fixing roller 41. A commercial power source 65 as an alternate current signal (described later, refer to FIG. 4) is supplied to the heaters 44-1 and 44-2 of the fixing device 40, so that the heaters 44-1 and 44-2 generate heat. The temperature detection sensor 43 formed of a thermistor is disposed on the right side of the fixing roller 41 for detecting a surface temperature of the fixing roller 41.

In the embodiment, the sheet discharge portion 50 includes a sheet transportation path sensor 51 and a pair of discharging rollers 52*a* and 52*b*. The discharging rollers 52*a* and 52*b* are arranged on the downstream side of the fixing device 40 in the transportation path 102 to face each other with the recording medium 100 in between. A motor (not shown) is provided for driving the discharging rollers 52*a* and 52*b*.

Figure 3:
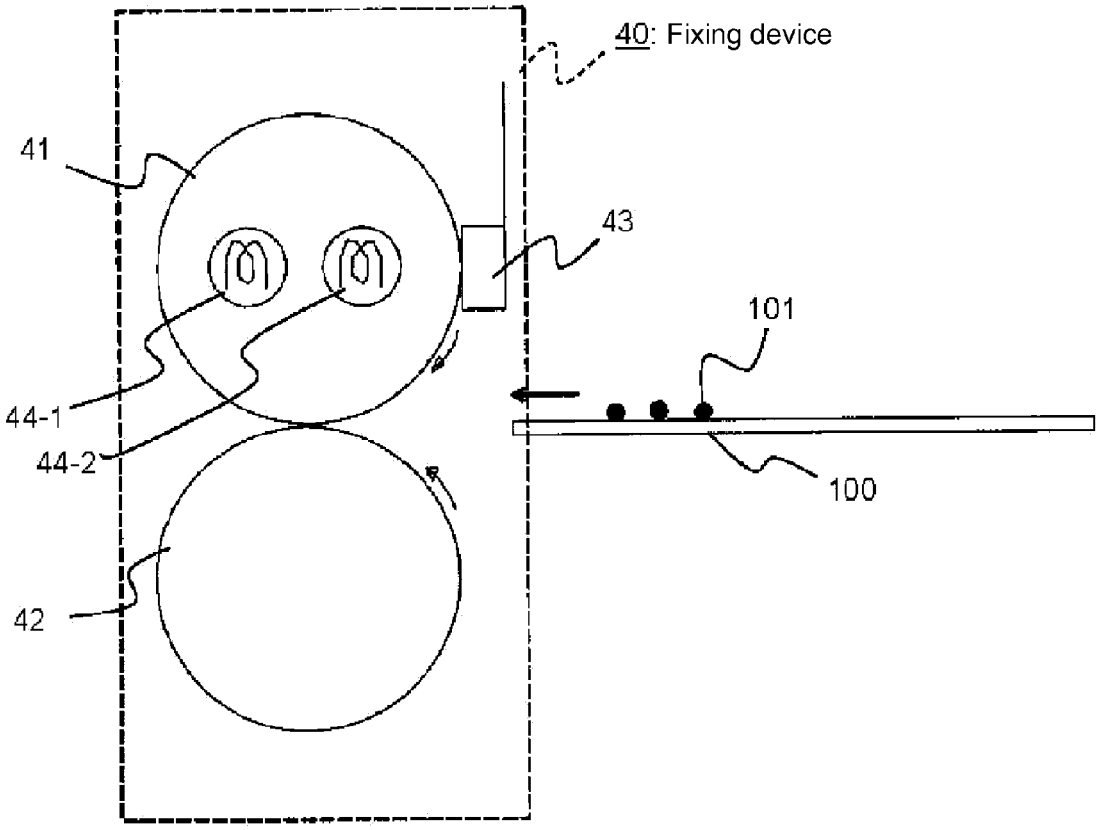
FIG. 3 is a schematic view showing a configuration of a fixing device of the image forming apparatus according to the first embodiment of the present invention.

FIG. 3 is a schematic view showing a configuration of the fixing device 40 of the image forming apparatus 10 according to the first embodiment of the present invention.

As shown in FIG. 3, the fixing device 40 includes the fixing roller 40 disposed above the transportation path 102, the pressing roller 42 arranged to contact with a lower side of the fixing roller 41 to rotate, the temperature detection sensor 43 arranged to contact with a side surface of the fixing roller 41, and the heaters 44-1 and 44-2 disposed inside the fixing roller 41 in a non-contact manner.

In the embodiment, after the toner image 101 is transferred to the recording medium 100, when the recording medium 100 passes through a nip region formed between the fixing roller 41 and the pressing roller 42, the toner image 101 is fixed to the recording medium 100.

In the embodiment, the heater 44-1 as a first heat source and the heater 44-2 as a second heat source are disposed inside the fixing roller 41 in the non-contact manner. The heater 44-1 is formed of, for example, a halogen lamp to be heating at a high heating capacity. The heater 44-1 as the first heat source is formed of, for example, a halogen lamp of 800 W to be heating at a high heating quantity. The heater 44-2 as the second heat source is formed of, for example, a halogen lamp of 400 W to be heating at a low heating quantity.

In the embodiment, the fixing roller 41 is supported with a supporting member (not shown) to be rotatable. The pressing roller 42 is supported with a supporting member (not shown) to be rotatable. Further, the pressing roller 42 is urged with an urging member (not shown) upwardly, so that the pressing roller 42 is pressed against the fixing roller 41.

In the embodiment, a gear (not shown) is disposed one end portion of the fixing roller 41 in a longitudinal direction thereof. Further, a gear (not shown) is disposed on a main body of the image forming apparatus 10 for engaging with the gear (not shown) disposed on the fixing roller 41. A motor (not shown) is provided for driving the gear (not shown) is disposed on the main body of the image forming apparatus 10, so that the gear (not shown) disposed on the fixing roller 41 engaging the gear (not shown) is disposed on the main body of the image forming apparatus 10 rotates in a clockwise direction in FIG. 3. When the fixing roller 41 rotates, the pressing roller 42 follows the fixing roller 41 to rotate in a counter clockwise direction in FIG. 3.

In the embodiment, the temperature detection sensor 43 is arranged at a side center portion of the fixing roller 41 in the longitudinal direction thereof to contact with the fixing roller 41. A control unit 80 (described later, refer to FIG. 4) is provided for monitoring a temperature of the fixing roller 41 with the temperature detection sensor 43. A conduction control unit 62 of the low voltage power source (described later, refer to FIG. 4) is controlled, so that the temperature of the fixing roller 41 is controlled.

Figure 4:
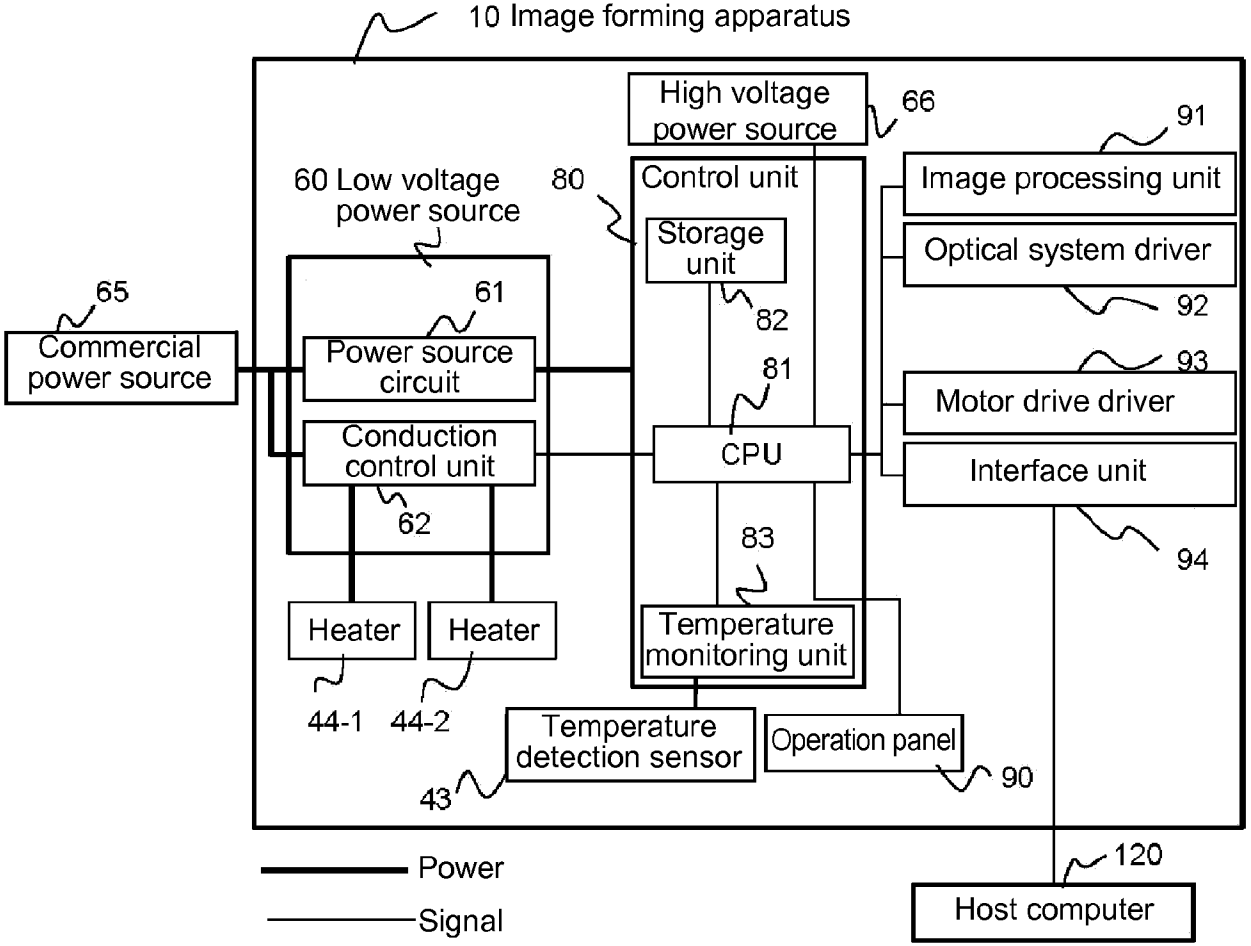
FIG. 4 is a block diagram showing a configuration of a control unit of the image forming apparatus according to the first embodiment of the present invention.

FIG. 4 is a block diagram showing a configuration of the control unit 80 of the image forming apparatus 10 according to the first embodiment of the present invention.

As shown in FIG. 4, the image forming apparatus 10 includes the low voltage power source 60, the heaters 44-1 and 44-2, the high voltage power source 66, the control unit 80, the temperature detection sensor 43, an operation panel 90, an image processing unit 91, an optical system driver 92, a motor drive driver 93, and an interface unit 94.

In the embodiment, the low voltage power source 60 includes a power source circuit 61 and the conduction control unit 62. Further, the control unit 80 includes a CPU 81, a storage unit 82, and a temperature monitoring unit 83.

In the embodiment, the commercial power source 65 as an alternate current power source supplies power to the image forming apparatus 10. More specifically, the commercial power source 65 supplies to the control unit 80 and the heaters 44-1 and 44-2 through the low voltage power source 60. The power source circuit 61 of the low voltage power source 60 converts power supplied from the commercial power source 65 to a specific voltage, so that the specific voltage is distributed inside the image forming apparatus 10 through the control unit 80. Further, the conduction control unit 62 supplies power supplied from the commercial power source 65 to the heaters 44-1 and 44-2, so that the heaters 44-1 and 44-2 are heated.

In the embodiment, the CPU 81 of the control unit 80 is connected top the storage unit 82 to be capable of reading and writing therebetween, and is further connected to the temperature detection sensor 43 through the temperature monitoring unit 83. The CPU 81 is connected to the conduction control unit 62, the high voltage power source 66, the operation panel 90, the image processing unit 91, the optical system driver 92, and the motor drive driver 93. Further, the CPU 81 is connected to a host computer 120 through the interface unit 94 to be capable of communicating with the host computer 120.

In the embodiment, the CPU 81 is provided for detecting the temperature of the fixing roller 41 with the temperature detection sensor 43, and for controlling through the temperature monitoring unit 83 such that the temperature of the fixing roller 41 becomes a specific target temperature. Further, the CPU 81 is provided for receiving a setting input from a user with the operation panel 90, and for displaying a status of the image forming apparatus 10. The CPU 81 is further provided for controlling conduction of the heater 44-1 according to an input from the operation panel 90 or the host computer 120, so that the temperature of the fixing roller 41 reaches the specific target temperature.

Figure 1:
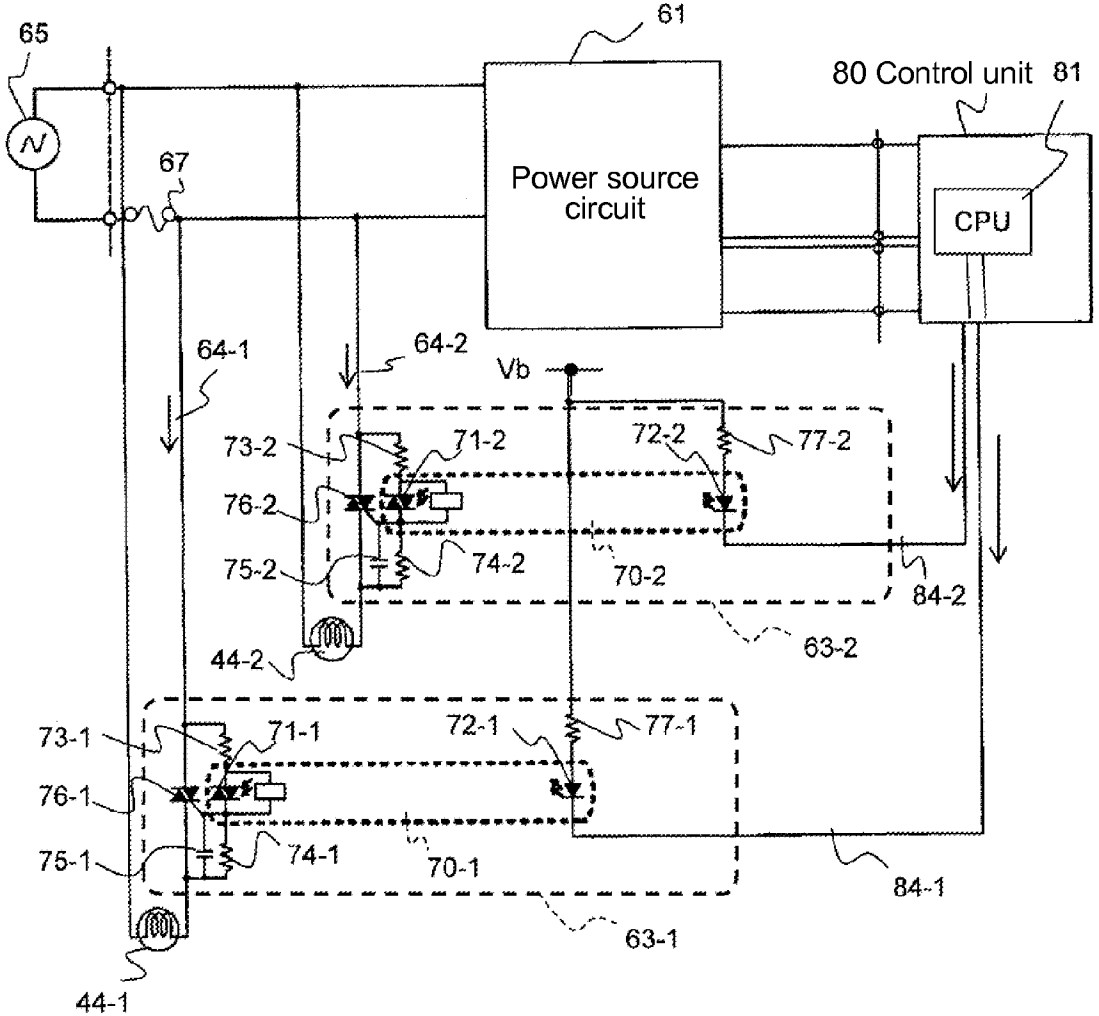
FIG. 1 is a block diagram showing a circuit configuration of a conduction control unit of an image forming apparatus according to a first embodiment of the present invention.

FIG. 1 is a block diagram showing a circuit configuration of the conduction control unit 62 of the image forming apparatus 10 according to the first embodiment of the present invention. As shown in FIG. 1, the conduction control unit 62 includes a conduction control circuit 63-1 for controlling conduction of the heater 44-1 and a conduction control circuit 63-2 for controlling conduction of the heater 44-2.

In the embodiment, the conduction control circuit 63-1 includes a phototriac coupler 70-1, a resistor 73-1, a resistor 74-1, a capacitor 75-1 a triac 76-1 as a first conduction control element, and a resistor 77-1. Further, the conduction control circuit 63-1 has one output side terminal connected to one of electrodes of the commercial power source 65 through a fuse 67, and the other output side terminal connected to the other one of the electrodes of the commercial power source 65 through a fuse 67. Further, the conduction control circuit 63-1 has one input side terminal connected to a power source Vb, and the other input side terminal connected to a heater control signal 84-1 of the CPU 81 of the control unit 80.

In the embodiment, the phototriac coupler 70-1 of the conduction control circuit 63-1 includes a light emitting diode 72-1 on an input side thereof and a photo transistor 71-1 on an output side thereof. The light emitting diode 72-1 on the input side has an anode connected to the power source Vb through the resistor 77-1. The light emitting diode 72-1 on the input side has a cathode connected to the heater control signal 84-1 of the CPU 81. The photo transistor 71-1 on the output side has one terminal connected to the commercial power source 65 through the resistor 73-1 and the fuse 67. The photo transistor 71-1 on the output side has the other terminal connected to a gate of the triac 76-1 and the heater 44-1 through the resistor 74-1 and the capacitor 75-1.

In the embodiment, the fuse 67 functions as a protection element. When an excessive current flows through the heater 44-1, the fuse 67 brakes, thereby protecting the image forming apparatus 10. The triac 76-1 is connected to the commercial power source 65 through the heater 44-1, and has a gate connected to the other terminal of the photo transistor 71-1.

In the embodiment, the conduction control circuit 63-1 is provided for controlling the commercial power source 65 with the heater control signal 84-1 as a first conduction control signal, and for supplying a heater conduction current 64-1 as a first alternate current signal to the heater 44-1.

In the embodiment, the conduction control circuit 63-2 has a configuration similar to that of the conduction control circuit 63-1. Accordingly, the conduction control circuit 63-2 is provided for controlling the commercial power source 65 with the heater control signal 84-2 as a second conduction control signal, and for supplying a heater conduction current 64-2 as a second alternate current signal to the heater 44-2.

An operation of the image forming apparatus 10 will be explained next with reference to FIG. 2. It is noted that the recording medium 100 is transported from the upstream side to the downstream side along the transportation path 102. The sheet storage cassette 110 is situated at the most upstream side, and the stacker portion 55 is situated at the most downstream side.

In the embodiment, the image forming apparatus 10 is connected to the host computer 120 through a cable or wireless. When the host computer 120 transfers the print data to the image forming apparatus 10 and the image forming apparatus 10 receives an instruction of the printing operation, a plurality of the recording sheets 100 is separated and transported toward the downstream side of the transportation path 102 one by one.

In the embodiment, the image forming units 22 (22-1 to 22-4) are arranged at four locations from the right side in FIG. 2 in the order of black (K), yellow (Y), magenta (M), and cyan (C). As soon as the recording medium 100 is transported, the rollers in each of the image forming units (22-1 to 22-4) start rotating, so that the photosensitive drum 23 rotates completely one rotation before the recording medium 100 reaches the photosensitive drum 23.

In the embodiment, when the motor (not shown) rotates the sheet supply roller 13*a*, the retards roller 13*b* contacting with the sheet supply roller 13*a* follows the sheet supply roller 13*a* to rotate. Accordingly, the sheet supply roller 13*a* and the retards roller 13*b* sandwich the recording medium 100 transported from the hopping roller 12, and the sheet supply sensor 14 is turned on. After the register rollers 15*a* and 15*b* arranged on the downstream side of the transportation path 102 transport the recording medium 100, the writing start position sensor 16 is turned on. After a specific period of time after the writing start position sensor 16 is turned on, the LED head 25 of each of the image forming units 22 (22-1 to 22-4) of black (K), yellow (Y), magenta (M), and cyan (C) starts exposing, so that the static latent image corresponding to each color is formed on the photosensitive drum 23.

In the embodiment, the transportation belt 30 is disposed on the downstream side of the transportation path 102 for transporting the recording medium 100. When the roller 31 starts rotating, the transportation belt 30 extended between the rollers 31 and 32 is driven along the transportation path 102. When the transportation belt 30 moves, the recording medium 100 is transported to the image forming units 22 (22-1 to 22-4) of black (K), yellow (Y), magenta (M), and cyan (C) in this order.

In the embodiment, in each of the image forming units (22-1 to 22-4) of black (K), yellow (Y), magenta (M), and cyan (C), the photosensitive drum 23 is arranged to rotate in the clockwise direction, and the charging roller 24 is provided for charging the surface of the photosensitive drum 23 uniformly. After the charging roller 24 charges surface of the photosensitive drum 23 uniformly, the LED head 25 irradiates light corresponding to the image information received from the upper device on the surface of the photosensitive drum 23, so that the static latent image is formed on the surface of the photosensitive drum 23. After the static latent image is formed on the surface of the photosensitive drum 23, the toner supply roller 27 and the developing roller 26 develop the static latent image to form the toner image 101.

In the embodiment, after the static latent image is developed to form the toner image 101, the photosensitive drum 23 and the transfer roller 21 sandwich and transport the transportation belt 30 and the recording medium 100. Further, a high voltage of +1,000 to 3,000 V is applied to the transfer roller 21, so that toner on the photosensitive drum 23 are attracted to the recording medium 100, so that the toner image 101 is transferred to the recording medium 100. After the toner image 101 is transferred to the recording medium 100, the recording medium 100 is transported to the fixing device 40, so that the toner image 101 is fixed. The cleaning unit (not shown) scrapes off toner remaining on the photosensitive drum 23, so that the photosensitive drum 23 is ready for forming the toner image 101 in the next printing operation.

After the toner image 101 in each of the four colors, i.e., black (K), yellow (Y), magenta (M), and cyan (C), is transferred to the recording medium 100, in the fixing device 40, the fixing roller 41 and the pressing roller 42 sandwich the recording medium 100 at the nip region formed between the fixing roller 41 and the pressing roller 42. Accordingly, the fixing roller 41 applies heat and the pressing roller 42 applies pressure to the recording medium 100 at the nip region, so that toner is melted and the toner image 101 is fixed.

After the toner image 101 is fixed to the recording medium 100, the sheet transportation path sensor 51 detects the leading edge of the recording medium 100, and the discharge rollers 52*a* and 52*b* rotate to discharge the recording medium 100, so that the recording medium 100 is discharged on the stacker portion 55.

An operation of the conduction control unit 62 will be explained next with reference to FIG. 1. When the CPU 81 sets the logic value of the heater control signal 84-1 to L, the light emitting diode 72-1 is turned on to emit light. While the light emitting diode 72-1 emits light, when the commercial power source 65 crosses a zero cross point thereof, the photo transistor 71-1 is conducted. When the photo transistor 71-1 is conducted, the triac 76-1 is conducted, so that the heater conduction current 64-1 is supplied to the heater 44-1 over the half cycle of the commercial power source 65.

In the embodiment, the conduction control circuit 63-1 includes the phototriac coupler 70-1 and the triac 76-1 as the conduction control elements. The conduction control elements switch between the conduction and the non-conduction at a zero cross timing of the commercial power source 65 according to the heater control signal 84-1 as the conduction control signal, so that the heater conduction current 64-1 as the alternate current signal is supplied to the heater 44-1.

In the embodiment, it is noted that the commercial power source 65 is an alternate current that switches a polarity thereof between positive and negative alternately. When the commercial power source 65 crosses the zero cross point at the zero cross timing, the commercial power source 65 becomes zero, and the polarity thereof is switched thereof between positive and negative. The photo transistor 72-1 or 72-2 turns on a gate signal of the triac 76-1 or 76-2 to start conduction of the alternate current, thereby reducing an excessive current load.

In the embodiment, after the gate signal of the triac 76-1 or 76-2 is changed from the on state to the off state, an alternate voltage of the commercial power source 65 becomes zero, the conduction thereof thereafter becomes off. It is noted that the heaters 44-1 and 44-2 include mainly resistor elements. Further, a peripheral circuit of the triac 76-1 or 76-2 is mainly formed of a resistor and a phototriac that operate proportional to a voltage. Accordingly, the alternate current flowing through the heaters 44-1 and 44-2 has an alternate waveform synchronized with that of the alternate voltage.

In the embodiment, the CPU 81 retrieves the specific pattern for controlling the conduction of the heaters 44-1 and 44-2 from the storage unit 82. Accordingly, the CPU 81 controls the conduction control circuit 63-1 and the conduction control circuit 63-2 to switch between the conduction and the non-conduction of the heaters 44-1 and 44-2 according to the heater control signal 84-1 and the heater control signal 84-2.

Figure 5A:
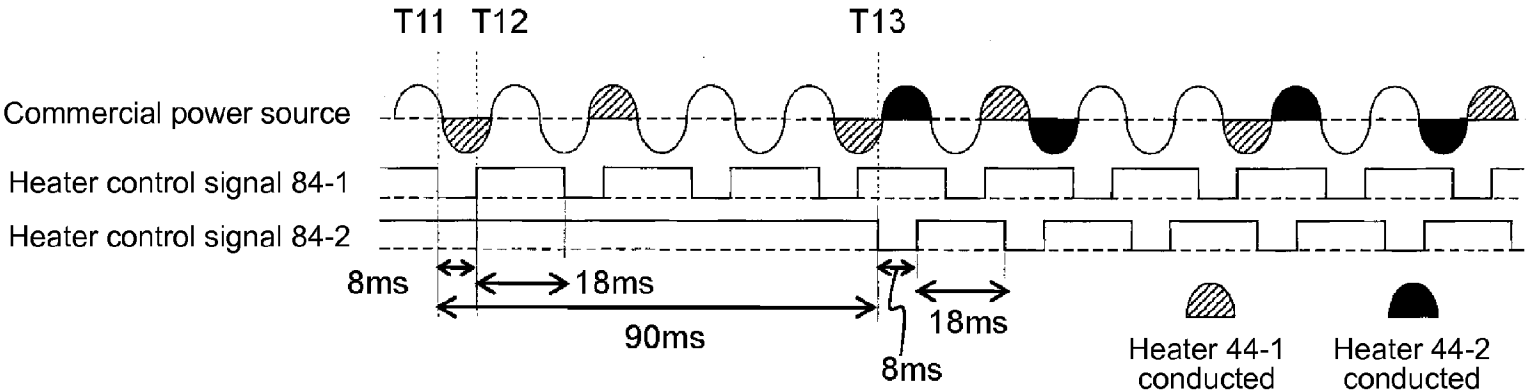
FIGS. 5(*a*) and 5(*b*) are time charts showing conduction control of the image forming apparatus according to the first embodiment of the present invention, wherein FIG. 5(*a*) is a time chart showing the conduction control of the image forming apparatus when a commercial power source has a power source frequency of 50 Hz, and FIG. 5(*b*) is a time chart showing the conduction control of the image forming apparatus when the commercial power source has the power source frequency of 60 Hz.
Figure 5B:
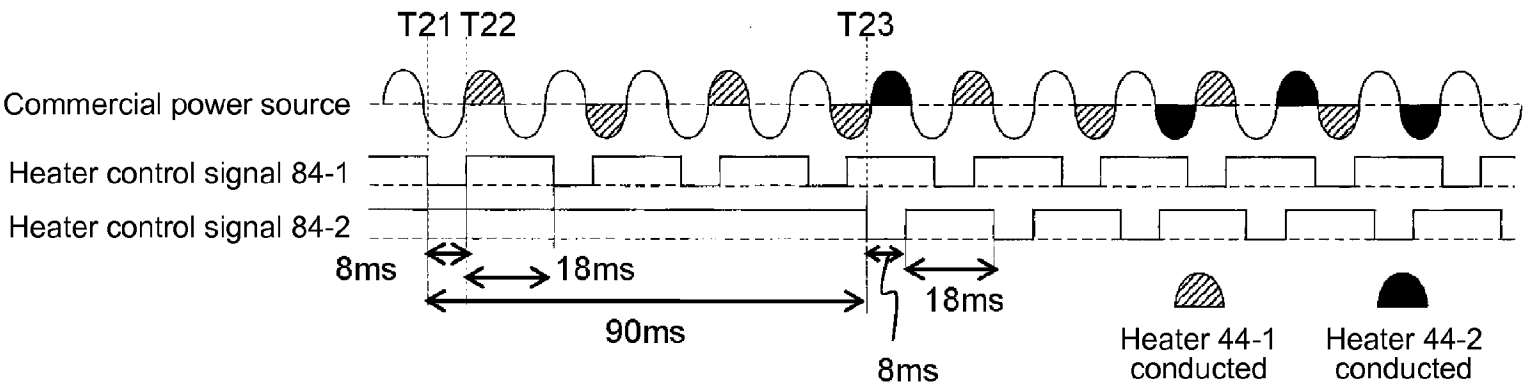

FIGS. 5(*a*) and 5(*b*) are time charts showing the conduction control of the image forming apparatus 10 according to the first embodiment of the present invention. More specifically, FIG. 5(*a*) is a time chart showing the conduction control of the image forming apparatus 10 when the commercial power source 65 has a power source frequency of 50 Hz, and FIG. 5(*b*) is a time chart showing the conduction control of the image forming apparatus 10 when the commercial power source 65 has the power source frequency of 60 Hz. In FIGS. 5(*a*) and 5(*b*), the horizontal axis of all time charts represents a time, and the vertical axis of the commercial power source 65 represents the power source voltage. The vertical axes of the heater control signal 84-1 and the heater control signal 84-2 represent the logic values H and L, in which an upper level of the vertical axes represents the logic value H.

First, the conduction control of the image forming apparatus 10 will be explained in the case that the commercial power source 65 has the power source frequency of 50 Hz shown in FIG. 5(*a*). At a timing T11, the CPU 81 sets the logic value of the heater control signal 84-1 to L, so that the conduction control circuit 63-1 of the conduction control unit 62 controls the heater 44-1 to be conducted. At this moment, the phototriac coupler 70-1 and the triac 76-1 of the conduction control circuit 63-1 switch such that the heater 44-1 is conducted over the half cycle at the zero cross point of the commercial power source 65 when the logic level of the heater control signal 84-1 is at L.

At a timing T12, the CPU 81 sets the logic value of the heater control signal 84-1 to H. At this moment, the phototriac coupler 70-1 and the triac 76-1 of the conduction control circuit 63-1 switch such that the heater 44-1 is non-conducted over the half cycle at the zero cross point of the commercial power source 65 when the logic level of the heater control signal 84-1 is at H. The triac 76-1 has a characteristic such that the triac 76-1 continues the conduction once the triac 76-1 is conducted until the current disappears. Accordingly, at a timing T12, even when the logic level of the heater control signal 84-1 is at H, the heater 44-1 is conducted until the next zero cross point of the commercial power source 65.

In the embodiment, when the logic level of the heater control signal 84-1 as the conduction control signal is at L, the triac 76-1 is capable of being controlled to be conducted from the zero cross point of the commercial power source 65 to the next zero cross point. Further, when the logic level of the heater control signal 84-1 as the conduction control signal is at H, the triac 76-1 is not capable of being controlled not to be conducted at the next zero cross point of the commercial power source 65.

In the embodiment, after the timing T12, over 90 ms as a first period of time, the CPU 81 performs a first pattern or a specific pattern, in which the CPU 81 sets the heater control signal 84-1 to L for 8 ms, and to H for 18 ms, so that the heater 44-1 is switched between the conduction and the non-conduction. At a timing T13, the CPU 81 performs a second pattern, in which the CPU 81 sets the heater control signal

84-2 to L for 8 ms, and to H for 18 ms, so that the conduction control circuit 63-1 of the conduction control unit 62 switches the heater 44-2 between the conduction and the non-conduction. At this moment, the CPU 81 controls such that the period of time when the heater control signal 84-2 is set to L is not overlapped with the period of time when the heater control signal 84-1 is set to L. Further, the phototriac coupler 70-1 and the triac 76-1 of the conduction control circuit 63-1 are switched to conduct the heater 44-2 at the zero cross point of the commercial power source 65 when the heater control signal 84-2 is at L.

In the embodiment, the cycle of the heater control signal 84-1 as the first pattern and the cycle of the heater control signal 84-2 as the second pattern are both 26 ms. Further, it is configured such that the period of time when the heater control signal 84-1 as the first pattern outputs L to the phototriac coupler 70-1 to be capable of being controlled is not overlapped with the period of time when the heater control signal 84-2 as the second pattern outputs L to the phototriac coupler 70-2 to be capable of being controlled, so that both of the heaters 44-1 and 44-2 are not conducted at the same time. Accordingly, a large current does not concurrently flow through the fuse 67 as the protection element of the power source supplied to the heaters 44-1 and 44-2, thereby reducing the risk of breaking the fuse 67.

The conduction control of the image forming apparatus 10 will be explained next in the case that the commercial power source 65 has the power source frequency of 60 Hz shown in FIG. 5(*a*). In the embodiment, the image forming apparatus 10 is not provided with a zero cross detection unit. Accordingly, in the control unit 80 or the CPU 81, the power source frequency of the commercial power source 65 or the zero cross point is not known. Accordingly, the CPU 81 performs the conduction control of the heaters 44-1 and 44-2 in the way similar to that case that the commercial power source 65 has the power source frequency of 50 Hz.

More specifically, in the embodiment, the CPU 81 performs the conduction control from a timing T21 to a timing T23 in the way similar to that from the timing T11 to the timing T13.

In the embodiment, the conduction control circuit 63-1 and the conduction control circuit 63-2 of the heaters 44-1 and 44-2 have the specific configuration described above, and perform the specific conduction control on the heaters 44-1 and 44-2. More specifically, in the embodiment, the conduction control circuit 63-1 and the conduction control circuit 63-2 have the function of conducting the heaters 44-1 and 44-2 per every half cycle regardless of the power source frequency of the commercial power source 65. Further, the conduction control circuit 63-1 and the conduction control circuit 63-2 perform the specific conduction control on the heaters 44-1 and 44-2 such that the current supplied to the heaters 44-1 and 44-2 is not shifted on either one of the positive side and the negative side.

A method of the conduction control in the first embodiment will be explained next. When the heater control signal 84-1 and the heater control signal 84-2 are repeatedly set to L in the specific pattern, the conduction control circuit 63-1 and the conduction control circuit 63-2 conduct the heaters 44-1 and 44-2 only in the half cycle.

In the embodiment, an upper limit of the period of time when the heater control signal 84-1 and the heater control signal 84-2 are set to L is the maximum value of the half cycle of the commercial power source 65. When it is supposed that the commercial power source 65 has the power source frequency of 60 Hz with the deviation of ±2%, the maximum value of the half cycle of the commercial power source 65 is about 8.17 ms. Accordingly, the upper limit of the period of time when the heater control signal 84-1 and the heater control signal 84-2 are set to L is 8.16 ms.

In the embodiment, when the heaters 44-1 and 44-2 are controlled, it is imperative to prevent power supplied to the heaters 44-1 and 44-2 from being excessively decreased. Accordingly, in the embodiment, a lower limit of the period of time when the heater control signal 84-1 and the heater control signal 84-2 are set to L is set a quarter of the minimum value of the half cycle of the commercial power source 65. When it is supposed that the commercial power source 65 has the power source frequency of 50 Hz with the deviation of −2%, the minimum value of the half cycle of the commercial power source 65 is about 10.2 ms and the quarter thereof is 2.55 ms. Accordingly, the lower limit of the period of time when the heater control signal 84-1 and the heater control signal 84-2 are set to L is 2.55 ms.

In the next step, the heater control signal 84-1 and the heater control signal 84-2 are set to H, and the phototriac coupler 70-1 and the phototriac coupler 70-2 are turned off, so that it is set that the heaters 44-1 and 44-2 are in the non-conduction state at least for the half cycle.

In the embodiment, a lower limit of the period of time when the heater control signal 84-1 and the heater control signal 84-2 are set to H is the minimum value of the half cycle of the commercial power source 65. When it is supposed that the commercial power source 65 has the power source frequency of 60 Hz with the deviation of −2%, the minimum value of the half cycle of the commercial power source 65 is about 10.2 ms. Accordingly, the lower limit of the period of time when the heater control signal 84-1 and the heater control signal 84-2 are set to L is 10.3 ms.

In the embodiment, when the heaters 44-1 and 44-2 are controlled, it is imperative to prevent power supplied to the heaters 44-1 and 44-2 from being excessively decreased. Accordingly, in the embodiment, an upper limit of the period of time when the heater control signal 84-1 and the heater control signal 84-2 are set to H is set four times the maximum value of the half cycle of the commercial power source 65. When it is supposed that the commercial power source 65 has the power source frequency of 60 Hz with the deviation of ±2%, the minimum value of the half cycle of the commercial power source 65 is about 8.17 ms and the four times thereof is 32.68 ms. Accordingly, the upper limit of the period of time when the heater control signal 84-1 and the heater control signal 84-2 are set to H is 32.68 ms.

As explained above, in the embodiment, the period of time when the heater control signal 84-1 and the heater control signal 84-2 are set to L is between 2.55 and 8.16 ms. Further, the period of time when the heater control signal 84-1 and the heater control signal 84-2 are set to H is between 10.3 and 32.68 ms.

Further, in the embodiment, the conduction cycle is the sum of the period of time when the heater control signal 84-1 and the heater control signal 84-2 are set to L and the period of time when the heater control signal 84-1 and the heater control signal 84-2 are set to H. It is imperative to set the conduction cycle to be different from the range of the power source cycle of the commercial power source 65. For example, when the period of time when the heater control signal 84-1 and the heater control signal 84-2 are set to L is 5 ms, and the period of time when the heater control signal 84-1 and the heater control signal 84-2 are set to H is 15 ms, the conduction cycle of the heater control signal 84-1 and the heater control signal 84-2 is 20 ms. When the commercial power source 65 has the power source frequency of 50 Hz, the power source cycle of the commercial power source 65 is 20 ms, double of the conduction cycle. When the power source frequency is a multiple number of the conduction cycle, even if the heater control signal 84-1 and the heater control signal 84-2 are set to L, there is a case that the zero cross point is not crossed, so that the heaters 44-1 and 44-2 are not conducted. Accordingly, in the embodiment, it is set such that the conduction cycle of the heater control signal 84-1 and the heater control signal 84-2 is different from the range of the power source cycle, different from the range of the multiple number of the power source cycle, and different from the range of the product of a natural integer of the power source cycle.

In the embodiment, it is supposed that the range of the power source frequency is 50 Ha±2% or 60 Hz±2%. When the range of the power source frequency is 50 Ha±2%, the range of the power source cycle is 19.6 to 20.4 ms. When the range of the power source frequency is 60 Ha±2%, the range of the power source cycle is 16.3 to 17.0 ms. Accordingly, the CPU 81 of the control unit 80 is configured to control the switch between the conduction and the non-conduction of the heaters 44-1 and 44-2 in the conduction cycle different from the range of the multiple number of the power source cycle, and the range of the product of the natural integer of the power source cycle.

In the embodiment, as shown in FIGS. 5(*a*) and 5(*b*), the period of time when the heater control signal 84-1 and the heater control signal 84-2 are set to L is 8 ms, and the period of time when the heater control signal 84-1 and the heater control signal 84-2 are set to H is 18 ms.

Figure 6A:
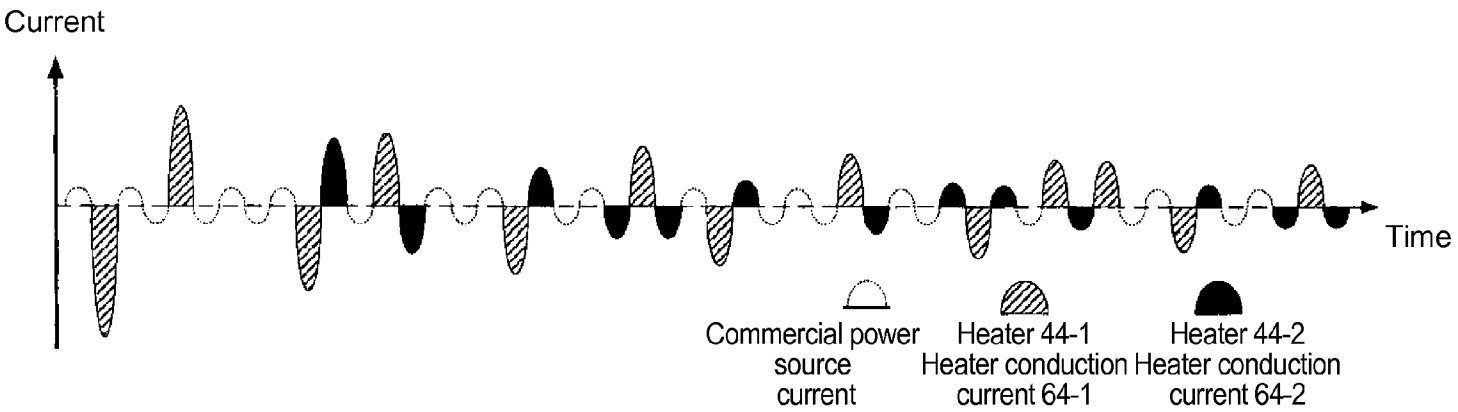
FIGS. 6(*a*) and 6(*b*) are time charts showing a heater current of the image forming apparatus according to the first embodiment of the present invention, wherein FIG. 6(*a*) is a time chart showing the heater current of the image forming apparatus when the commercial power source has the power source frequency of 50 Hz, and FIG. 6(*b*) is a time chart showing the heater current of the image forming apparatus when the commercial power source has the power source frequency of 60 Hz.
Figure 6B:
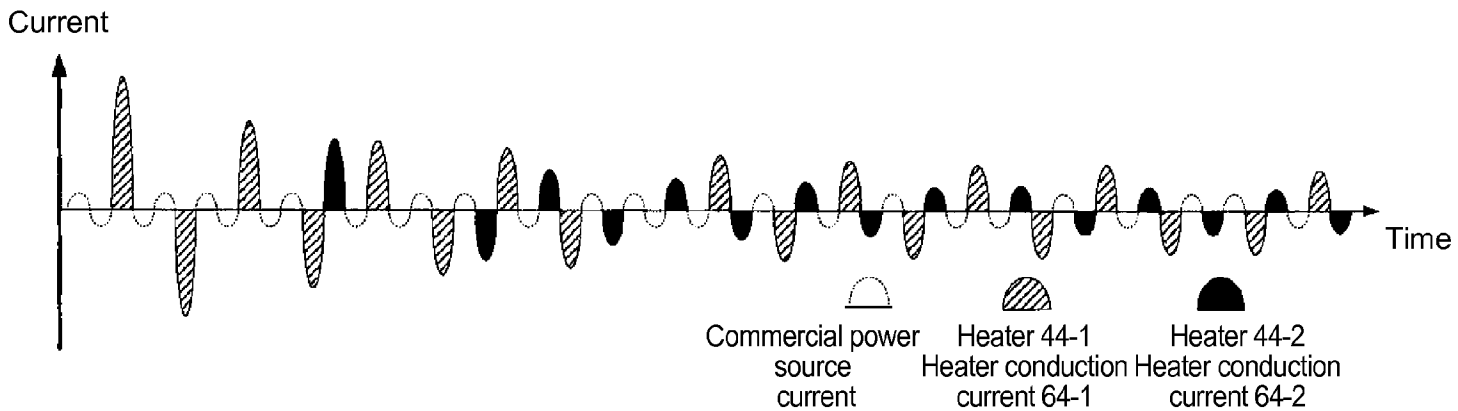

FIGS. 6(*a*) and 6(*b*) are time charts showing the heater current of the image forming apparatus 10 according to the first embodiment of the present invention. More specifically, FIG. 6(*a*) is a time chart showing the heater current of the image forming apparatus 10 when the commercial power source 65 has the power source frequency of 50 Hz, and FIG. 6(*b*) is a time chart showing the heater current of the image forming apparatus 10 when the commercial power source 65 has the power source frequency of 60 Hz.

In the embodiment, the heaters 44-1 and 44-2 are formed of the halogen lamps. The halogen lamp includes an element formed of tungsten, and tungsten has a resistivity with a small value in a room temperature. When the heaters 44-1 and 44-2 are heated the resistivity increases with time, thereby the conduction current decreases.

Further, in the embodiment, the heater control signal 84-1 is output in the specific pattern and the first pattern. When the heater control signal 84-1 is at L and the zero cross point of the commercial power source 65, the heater 44-1 is conducted over the half cycle. Accordingly, it is possible to reduce the effective value of the heater current supplied to the heaters 44-1 and 44-2. When the effective value of the heater current supplied to the heaters 44-1 and 44-2 is decreased, it is possible to extend the life of the heaters 44-1 and 44-2, or the life of the fuse 67 as the protection element of the heaters 44-1 and 44-2. Further, the current supplied to the heaters 44-1 and 44-2 is not shifted on either one of the positive side and the negative side, and it is possible to suppress the high frequency current.

As explained above, in the embodiment, the image forming apparatus 10 includes the phototriac coupler 70-1 and the phototriac coupler 70-2 operating at the zero cross point of the commercial power source 65. Further, it is controlled in the simple way in which the conduction control circuit 63-1 and the conduction control circuit 63-2 are turned on and off in the specific pattern. Accordingly, it is possible to extend the life of the heaters 44-1 and 44-2, or the life of the fuse 67 as the protection element of the heaters 44-1 and 44-2. Further, it is possible to suppress the high frequency current.

Further, in the embodiment, when the heater control signal 84-1 and the heater control signal 84-2 output in the specific pattern are at L, and the commercial power source 65 is at the zero cross point, the heaters 44-1 and 44-2 are conducted over the half cycle. Accordingly, it is possible to reduce the effective value of the heater current supplied to the heaters 44-1 and 44-2.

Further, in the embodiment, the cycle of the heater control signal 84-1 as the first pattern and the cycle of the heater control signal 84-2 as the second pattern are 26 ms, the same value. Further, it is configured such that the period of time when the heater control signal 84-1 outputs L to the phototriac coupler 70-1 to be capable of being controlled is not overlapped with the period of time when the heater control signal 84-2 outputs L to the phototriac coupler 70-2 to be capable of being controlled. Accordingly, it is possible to reduce the current flowing to the fuse 67 as the protection element of the power source supplied to the heaters 44-1 and 44-2 all at once, thereby reducing the risk of breaking the fuse 67.

Second Embodiment

A second embodiment of the present invention will be explained next. In the second embodiment, the image forming apparatus 10 has a configuration similar to that of the image forming apparatus 10 in the first embodiment. In the drawings, components similar to those in the first embodiment are designated with the same reference numerals.

Figure 7A:
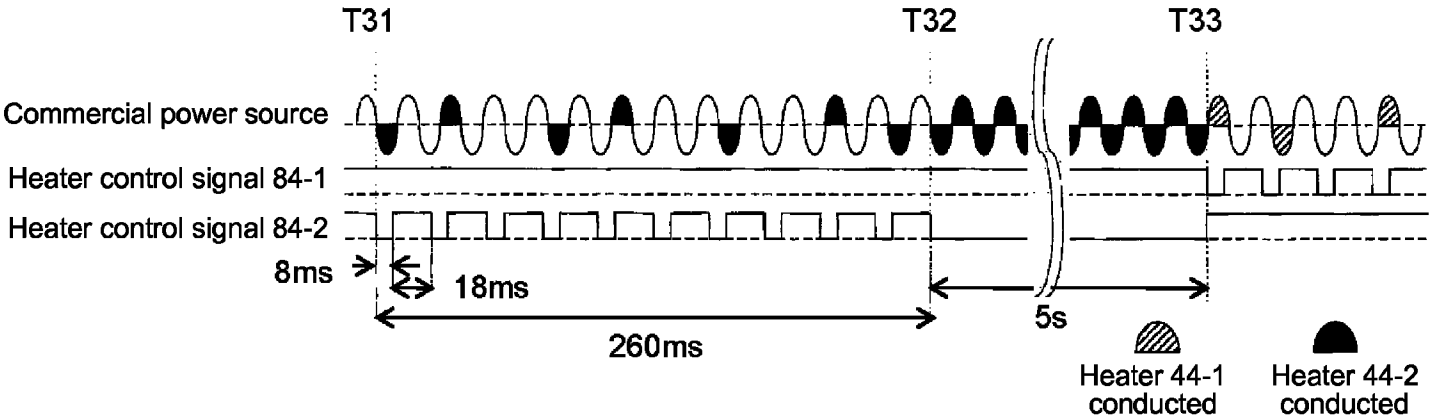
FIGS. 7(*a*) and 7(*b*) are time charts showing conduction control of the image forming apparatus according to a second embodiment of the present invention, wherein FIG. 7(*a*) is a time chart showing the conduction control of the image forming apparatus when the commercial power source has the power source frequency of 50 Hz, and FIG. 7(*b*) is a time chart showing the conduction control of the image forming apparatus when the commercial power source has the power source frequency of 60 Hz.
Figure 7B:
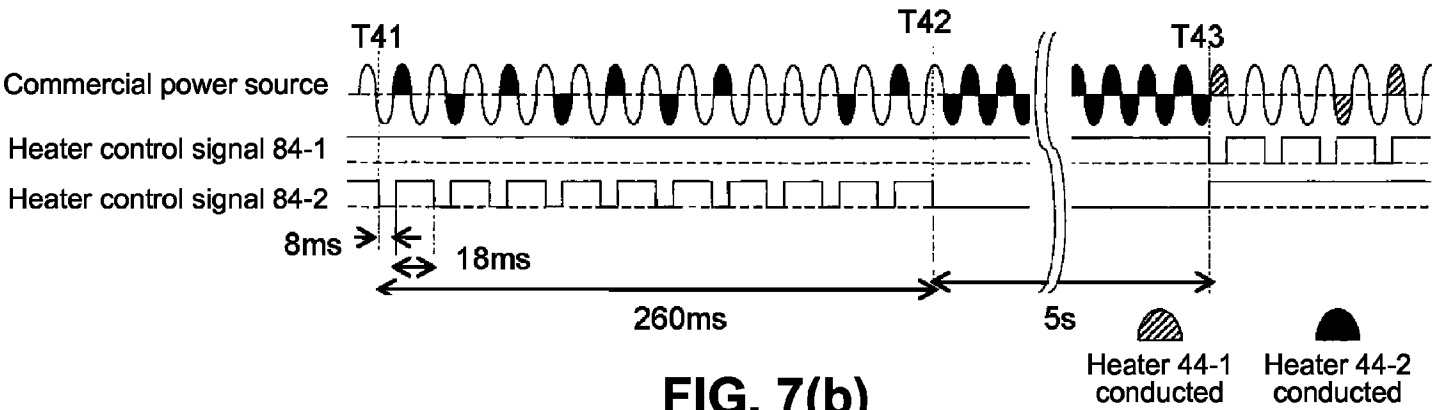

FIGS. 7(*a*) and 7(*b*) are time charts showing conduction control of the image forming apparatus 10 according to the second embodiment of the present invention. More specifically, FIG. 7(*a*) is a time chart showing the conduction control of the image forming apparatus 10 when the commercial power source 65 has the power source frequency of 50 Hz, and FIG. 7(*b*) is a time chart showing the conduction control of the image forming apparatus 10 when the commercial power source 65 has the power source frequency of 60 Hz.

In general, when a temperature around the image forming apparatus 10 is lower than a specific temperature of a specification of the image forming apparatus 10, the resistivity of tungsten contained in the halogen lamps of the heaters 44-1 and 44-2 may become lower than a designed value. In this case, when the heater 44-1 with the high heating capacity is conducted, the heater current may exceed a design value.

In the second embodiment, different from the first embodiment, when the temperature detection sensor 43 as the temperature measuring portion detects a temperature smaller than a specific temperature, it is configured such that the heater 44-2 with the low heating capacity as the second heat source is conducted first. When the heater 44-2 as the second heat source is conducted and heated, the heater 44-1 as the first heat source heated with the heat from the heater 44-2, thereby increasing the resistivity of tungsten contained in the halogen lamp of the heater 44-1. Accordingly, it is possible to reduce the heater current supplied to the heater 44-1.

First, the conduction control of the image forming apparatus 10 will be explained in the case that the commercial power source 65 has the power source frequency of 50 Hz shown in FIG. 7(*a*). At a timing T31, the CPU 81 controls the conduction control circuit 63-2 of the conduction control unit 62 to set the logic value of the heater control signal 84-2 to L and output the heater control signal 84-2 over 8 ms. Then, the CPU 81 controls the conduction control circuit 63-2 of the conduction control unit 62 to set the logic value of the heater control signal 84-2 to H and output the heater control signal

84-2 over 18 ms. The CPU 81 repeats the above pattern as the third pattern to output the heater control signal 84-2 until a timing T32.

At this moment, the phototriac coupler 70-2 and the triac 76-2 of the conduction control circuit 63-2 switch such that the heater 44-2 is conducted over the half cycle at the zero cross point of the commercial power source 65 when the logic level of the heater control signal 84-2 is at L. Accordingly, the heater 44-2 is conducted and heats the heater 44-1 to increase the resistivity over a second period of time of 280 ms from the timing T31 and the timing T32.

In the embodiment, at a timing T32, the CPU 81 controls the conduction control circuit 63-2 of the conduction control unit 62 to set the logic value of the heater control signal 84-2 to L and output the heater control signal 84-2 all the time. At this moment, the phototriac coupler 70-2 and the triac 76-2 of the conduction control circuit 63-2 switch such that the heater 44-2 is conducted over the half cycle at all of the zero cross points of the commercial power source 65. Accordingly, the heater 44-2 is conducted and heats the heater 44-1 to increase the resistivity over a third period of time of 5 ms from the timing T32 and the timing T33.

In the embodiment, the CPU 81 controls the conduction control circuit 63-2 of the conduction control unit 62 to output the heater control signal 84-2 with the logic level L all the time over the third period of time after the CPU 81 controls the conduction control circuit 63-2 of the conduction control unit 62 to output the heater control signal 84-2 in a third pattern over the second period of time. Accordingly, the heater 44-2 is heated before the heater control signal 84-2 is output in the third pattern, so that it is possible to increase the resistivity. Further, as opposed to the case that the heater control signal 84-2 with the logic level L is output from the beginning, it is possible to reduce the heater current.

In the embodiment, at the timing T33, after the CPU 81 controls the conduction control circuit 63-2 of the conduction control unit 62 to set the logic value of the heater control signal 84-1 to L and output the heater control signal 84-1 for 8 ms, the CPU 81 controls the conduction control circuit 63-2 of the conduction control unit 62 to set the logic value of the heater control signal 84-1 to L and output the heater control signal 84-1 for 18 ms as a fourth pattern, so that the CPU repeats the fourth pattern. At this moment, the phototriac coupler 70-1 and the triac 76-1 of the conduction control circuit 63-1 switch such that the heater 44-1 is conducted over the half cycle at the zero cross point of the commercial power source 65 when the logic level of the heater control signal 84-1 is L.

FIG. 7(*b*) is a time chart showing the conduction control of the image forming apparatus 10 when the commercial power source 65 has the power source frequency of 60 Hz. In the embodiment, the CPU 81 performs the conduction control from a timing T41 to a timing T43 in the way similar to that from the timing T31 to the timing T33.

Figure 8A:
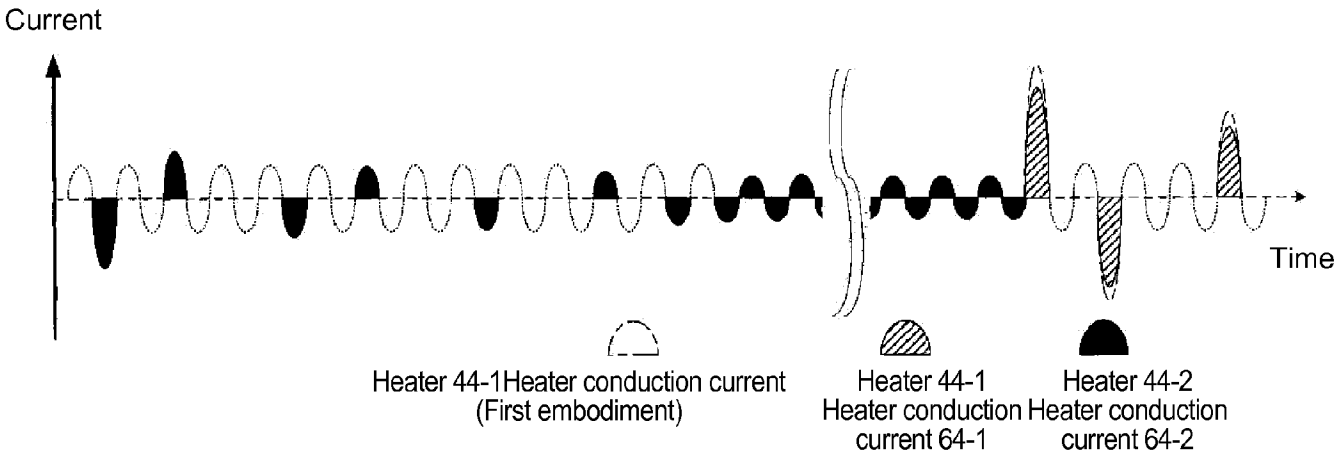
FIGS. 8(*a*) and 8(*b*) are time charts showing a heater current of the image forming apparatus according to the second embodiment of the present invention, wherein FIG. 8(*a*) is a time chart showing the heater current of the image forming apparatus when the commercial power source has the power source frequency of 50 Hz, and FIG. 8(*b*) is a time chart showing the heater current of the image forming apparatus when the commercial power source has the power source frequency of 60 Hz.
Figure 8B:
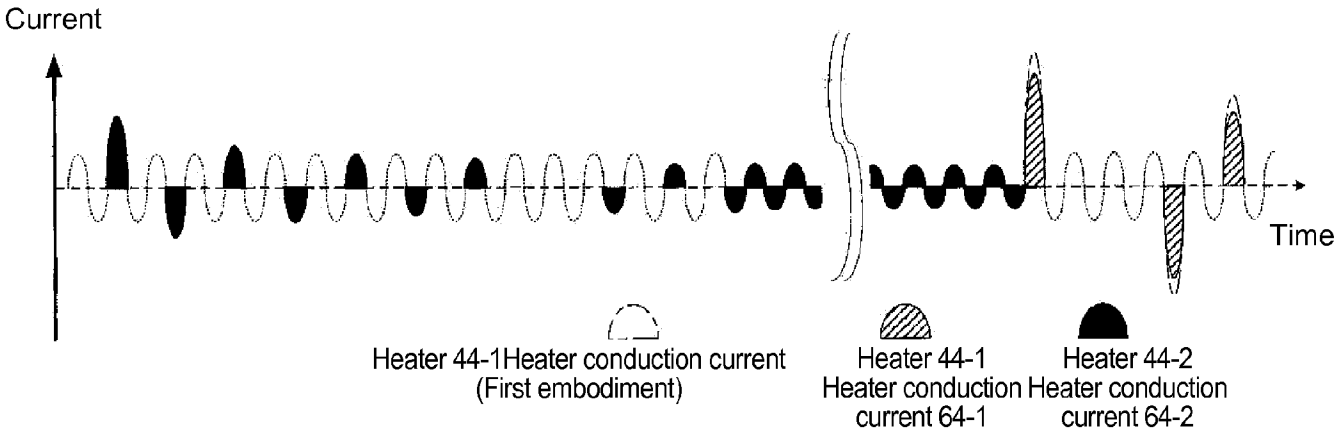

FIGS. 8(*a*) and 8(*b*) are time charts showing a heater current of the image forming apparatus 10 according to the second embodiment of the present invention. More specifically, FIG. 8(*a*) is a time chart showing the heater current of the image forming apparatus 10 when the commercial power source 65 has the power source frequency of 50 Hz, and FIG. 8(*b*) is a time chart showing the heater current of the image forming apparatus 10 when the commercial power source 65 has the power source frequency of 60 Hz.

As shown in FIGS. 8(*a*) and 8(*b*), the heater 44-2 with the low heating capacity is conducted first. Accordingly, the heater 44-2 with the low heating capacity heats the heater 44-1 with the high heating capacity, so that the resistivity of tungsten contained in the halogen lamp of the heater 44-1. As a result, when the heater 44-1 with the high heating capacity is conducted, it is possible to reduce the heater current supplied to the heater 44-1 with the high heating capacity. Therefore, it is possible to extend the life of the heaters 44-1 and 44-2, or the life of the fuse 67 as the protection element of the heaters 44-1 and 44-2.

As explained above, in the embodiment, the heater 44-2 with the low heating capacity is conducted first. Accordingly, the heater 44-2 with the low heating capacity heats the heater 44-1 with the high heating capacity, so that the resistivity of tungsten contained in the halogen lamp of the heater 44-1. As a result, when the heater 44-1 with the high heating capacity is conducted, it is possible to reduce the heater current supplied to the heater 44-1 with the high heating capacity. Therefore, it is possible to extend the life of the heaters 44-1 and 44-2, or the life of the fuse 67 as the protection element of the heaters 44-1 and 44-2.

Further, in the embodiment, the CPU 81 controls the conduction control circuit 63-2 of the conduction control unit 62 to output the heater control signal 84-2 with the logic level L all the time over the third period of time after the CPU 81 controls the conduction control circuit 63-2 of the conduction control unit 62 to output the heater control signal 84-2 in the third pattern over the second period of time. Accordingly, the heater 44-2 is heated before the heater control signal 84-2 is output in the third pattern, so that it is possible to increase the resistivity. Further, as opposed to the case that the heater control signal 84-2 with the logic level L is output from the beginning, it is possible to reduce the heater current.

The present invention is not limited to the first and second embodiments described above, and may be applicable to various modifications. For example, in the first and second embodiments, the present invention is applied to the image forming apparatus 10 as the printer of the tandem type. The present invention may be applied to a printer other than the tandem type, and further to a multiple function product having a copier function and a facsimile function, a facsimile, and a copier.

Further, in the first and second embodiments, the temperature detection sensor 43 is arranged at the center portion on the side surface of the fixing roller 41 in the longitudinal direction thereof. The arrangement is not limited thereto, and the temperature detection sensor 43 may be disposed in a non-contact state.

Further, in the first and second embodiments, the CPU 81 sets the logic level of the heater control signal 84-1 or the heater control signal 84-2 to H and outputs the heater control signal 84-1 or the heater control signal 84-2 for 18 ms after the CPU 81 sets the logic level of the heater control signal 84-1 or the heater control signal 84-2 to L and outputs the heater control signal 84-1 or the heater control signal 84-2 for 8 ms in the first to fourth patterns. The present invention is not limited thereto. As far as the control cycle of the heater control signal 84-1 and the heater control signal 84-2 is different from any of the range of the power source cycle, the range of the multiple numbers of the power source cycle, and the product of the natural integer of the power source cycle, the heater control signal 84-1 or the heater control signal 84-2 may be output in a different pattern.

The disclosure of Japanese Patent Application No. 2010-215768, filed on Sep. 27, 2010, is incorporated in the application by reference.

While the invention has been explained with reference to the specific embodiments of the invention, the explanation is illustrative and the invention is limited only by the appended claims.

What is claimed is:

1. An image forming apparatus, comprising:

a fixing device having a heat source, said heat source being arranged to heat when an alternate current signal is supplied thereto;

a conduction control circuit for controlling an alternate current power source with a conduction control signal, and for supplying the alternate current signal to the heat source, said conduction control circuit including a conduction control element for switching between conduction and non-conduction of the heat source through the alternate current signal at a zero cross timing of the alternate current power source according to the conduction control signal; and a control unit for outputting the conduction control signal in a specific pattern including a conduction period and a non-conduction period alternately repeating, wherein said control unit is configured to generate the conduction control signal at a timing not synchronizing with the zero cross timing, and said conduction control circuit is configured to generate the alternate current signal corresponding to a half wave of the alternate current power source when the zero cross timing is detected during the conduction period of the conduction control signal.

2. The image forming apparatus according to claim 1, wherein said control unit is arranged to output the conduction control signal in the specific pattern so that the conduction control element is conducted between 2.55 ms and 8.16 ms during the conduction period of the conduction control signal and the conduction control element is not conducted between 10.3 ms and 32.67 ms during the non-conduction period of the conduction control signal.

3. The image forming apparatus according to claim 1, wherein said control unit is arranged to output the conduction control signal in the specific pattern different from a cycle of the alternate current power source or a product of a natural integer of the cycle.

4. The image forming apparatus according to claim 1, wherein said control unit is arranged to output the conduction control signal in the specific pattern different from the range of the power source cycle between 19.6 ms and 20.4 ms or 16.3 ms and 17.0 ms.

5. An image forming apparatus, comprising:

a fixing device having a plurality of heat sources, said heat sources being arranged to heat when a plurality of alternate current signals is supplied thereto respectively;

a conduction control circuit for controlling an alternate current power source with a plurality of conduction control signals, and for supplying at least one of the alternate current signals to at least one of the heat sources, said conduction control circuit including a conduction control element for switching between conduction and non-conduction of the heat source through the alternate current signals at a zero cross timing of the alternate current power source according to the conduction control signals; and a control unit for outputting the at least one of the conduction control signal in a specific pattern.

6. The image forming apparatus according to claim 1, wherein said conduction control circuit is arranged to control the alternate current power source having a frequency of 50 Hz or 60 Hz, said conduction control circuit being arranged to be a common conduction control circuit for the frequencies of 50 Hz and 60 Hz capable of selectively inputting between the alternate current power source having the frequency of 50 Hz and the alternate current power source having the frequency of 60 Hz.

7. The image forming apparatus according to claim 5, wherein said conduction control circuit is arranged to control the alternate current power source having a frequency of 50 Hz or 60 Hz, said conduction control circuit being arranged to be a common conduction control circuit for the frequencies of 50 Hz and 60 Hz capable of selectively inputting between the alternate current power source having the frequency of 50 Hz and the alternate current power source having the frequency of 60 Hz.

8. The image forming apparatus according to claim 1, wherein said control unit is arranged to output the conduction control signal including a first conduction control signal and a second conduction control signal, said first conduction control signal has a first conduction period and a first cycle, said second conduction control signal has a second conduction period same as the first conduction period and a second cycle same as the first cycle, and said first conduction period is not overlapped with the second conduction period.

9. The image forming apparatus according to claim 1, wherein said control unit is arranged to output the second conduction control signal including the non-conduction period in a specific period of the first conduction control signal.

10. The image forming apparatus according to claim 9, wherein said control unit is arranged to output the conduction period of the second conduction control signal after the specific period after the control unit outputs the first conduction control signal.

11. The image forming apparatus according to claim 1, wherein said conduction control circuit is configured to generate the alternate current signal corresponding to the half wave of the alternate current power source regardless of the conduction period when the zero cross timing is detected during the conduction period of the conduction control signal.

12. An image forming apparatus, comprising:

a fixing device having a first heat source and a second heat source, said first heat source being arranged to heat with a high heating capacity when a first alternate current signal is supplied thereto, said second heat source being arranged to heat with a low heating capacity when a second alternate current signal is supplied thereto;

a conduction control circuit for controlling an alternate current power source with a first conduction control signal, and for supplying the first alternate current signal to the first heat source, said conduction control circuit being arranged to control the alternate current power source with a second conduction control signal, and for supplying the second alternate current signal to the second heat source, said conduction control circuit including a first conduction control element for switching between conduction and non-conduction of the first heat source through the first alternate current signal at a zero cross timing of the alternate current power source according to the first conduction control signal, said conduction control circuit including a second conduction control element for switching between conduction and non-conduction of the second heat source through the second alternate current signal at the zero cross timing of the alternate current power source according to the second conduction control signal; and a control unit for controlling the first conduction control signal and the second conduction control signal, wherein said control unit is arranged to output the first conduction control signal in a first pattern and the second conduction control signal in a second pattern after the control unit outputs the first conduction control signal in the first pattern for a first period of time.

13. The image forming apparatus according to claim 12, wherein said control unit is arranged to output the first conduction control signal in the first pattern so that the first conduction control element is conducted between 2.55 ms and 8.16 ms and the first conduction control element is not conducted between 10.3 ms and 32.67 ms.

14. The image forming apparatus according to claim 12, wherein said control unit is arranged to output the first conduction control signal in the first pattern having a cycle the same as that of the second pattern, said control unit being arranged to output the first conduction control signal so that the first conduction control element is capable of being controlled over a period of time not overlapped with a period of time that the second conduction control element is capable of being controlled when the control unit outputs the second conduction control signal.

15. The image forming apparatus according to claim 12, further comprising a temperature measuring portion for measuring a temperature of the fixing device, said control unit being arranged to output the first conduction control signal so that the first alternate current signal is supplied to the first heat source after the control unit outputs the second conduction control signal so that the second alternate current signal is supplied to the second heat source when the temperature measuring portion measures the temperature of the fixing device smaller than a specific temperature.

16. The image forming apparatus according to claim 15, wherein said control unit is arranged to output the first conduction control signal in a fourth pattern so that the first alternate current signal is supplied to the first heat source after the control unit outputs the second conduction control signal in a third pattern over a second period of time and outputs the second conduction control signal over a third period of time so that the second alternate current signal is supplied to the second heat source when the temperature measuring portion measures the temperature of the fixing device smaller than the specific temperature.

17. The image forming apparatus according to claim 16, wherein said control unit is arranged to output the first conduction control signal in the fourth pattern and the second conduction control signal in the third pattern so that the second conduction control element is not conducted between 10.3 ms and 32.67 ms after the second conduction control element is conducted between 2.55 ms and 8.16 ms.

18. The image forming apparatus according to claim 12, wherein each of said first conduction control element and said second conduction control element is formed of a phototriac.

19. The image forming apparatus according to claim 12, wherein said conduction control circuit is arranged to control the alternate current power source having a frequency of 50 Hz or 60 Hz, said conduction control circuit being arranged to be a common conduction control circuit for the frequencies of 50 Hz and 60 Hz capable of selectively inputting between the alternate current power source having the frequency of 50 Hz and the alternate current power source having the frequency of 60 Hz.

* * * * *